US006220907B1

(12) United States Patent
Shimizu

(10) Patent No.: US 6,220,907 B1
(45) Date of Patent: Apr. 24, 2001

(54) WATERCRAFT EXHAUST CONTROL

(75) Inventor: Takayuki Shimizu, Iwata (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 09/199,942

(22) Filed: Nov. 25, 1998

(30) Foreign Application Priority Data

Nov. 27, 1997 (JP) ..... 9-326098

(51) Int. Cl.[7] ..... B63H 21/32
(52) U.S. Cl. ..... 440/89; 60/324
(58) Field of Search ..... 440/89; 60/324; 181/226

(56) References Cited

U.S. PATENT DOCUMENTS 4,609,068 * 9/1986 Backlund ..... 181/226
4,643,272 * 2/1987 Gaffrig ..... 181/260
5,022,877 * 6/1991 Harbert ..... 440/89
5,556,314 * 9/1996 Fukuda et al. ..... 440/89

* cited by examiner

*Primary Examiner*—Sherman Basinger
(74) *Attorney, Agent, or Firm*—Knobbe, Martens, Olson & Bear LLP

(57) ABSTRACT

A personal watercraft having an exhaust system silencing arrangement that incorporates a silencing control valve at the discharge end of the exhaust system. The silencing control valve is maintained in a closed flow restricting and silencing position when operating under low speeds and before beginning planing so as to provide exhaust silencing. However, when accelerating to a planing condition, the control valve is opened so as to permit the attainment of desired power. This is done at a time when the silencing is not as important.

15 Claims, 4 Drawing Sheets

WATERCRAFT EXHAUST CONTROL

BACKGROUND OF THE INVENTION

This invention relates to a small watercraft such as a personal watercraft and more particularly to an improved exhaust system therefore.

There is a very popular class of watercraft referred to as "personal watercraft." The watercraft that fall into this class are of a wide variety of types but have in common the feature that they are designed to be operated primarily by a single rider operator and which may carry no more than three additional passengers. Frequently, the operator sits in a straddle fashion and if passengers are accommodated they sit in tandem with the operator. This is not necessarily true in all cases but it does indicate the compact nature of this type of watercraft.

This type of watercraft is also quite sporting in nature. Because of these factors, conventional boaters have some objections to this type of watercraft.

One feature which is objected to by some people with this type of watercraft is the noise which they generate. The engine exhaust is generally silenced by utilizing a plurality of expansion chambers that are disposed between the exhaust ports and the point of discharge of the exhaust gases to the atmosphere. Because of the small space available, more sophisticated exhaust systems like utilize an automotive or larger power boat applications are not possible.

Also, it is the conventional practice with many types of water propulsion systems to silence the engine exhaust noises by cooling the exhaust gases either through water jacketing the exhaust system or by dumping cooling water from the engine cooling jacket into the exhaust system. Frequently, both of these expedients are combined.

These types of systems are effective for some sound frequencies, but not all of those experienced with engines, particularly of the two cycle type. Because of the fact that there may be a high quantity of water in the exhaust, this makes the use of other types of exhaust silencers difficult.

It is, therefore, a principal object of this invention to provide an improved silencing system for a personal watercraft.

Many of the silencing devices employed for silencing exhaust sounds at certain frequencies or certain running conditions provide restriction in the air flow and can reduce maximum power output.

It is, therefore, a further object of this invention to provide an improved exhaust silencing device that can be utilized to provide silencing under some running conditions and which silencing is accomplished by restricting the exhaust flow but which, under other running conditions, does not provide this effect.

SUMMARY OF THE INVENTION

This invention is adapted to be embodied in a personal watercraft having a hull that defines a rider's area for accommodating a rider operator and not more than three additional passengers. An engine compartment is provided within the hull and contains a powering internal combustion engine. This engine drives a propulsion device for propelling the watercraft through the body of water in which it is operated. The engine is provided with an exhaust system by which exhaust gases are discharged to the atmosphere. This exhaust system includes at least one expansion chamber device that receives the exhaust gases from the engine and which eventually transmits them to the atmosphere. A conduit extends from this water trap device to an atmospheric discharge. A silencer valve is disposed in this conduit for silencing sounds in the exhaust by restricting the flow therethrough only under certain running conditions.

DETAILED DESCRIPTION OF THE PREFERRED EMBODIMENT OF THE INVENTION

Figure 1:
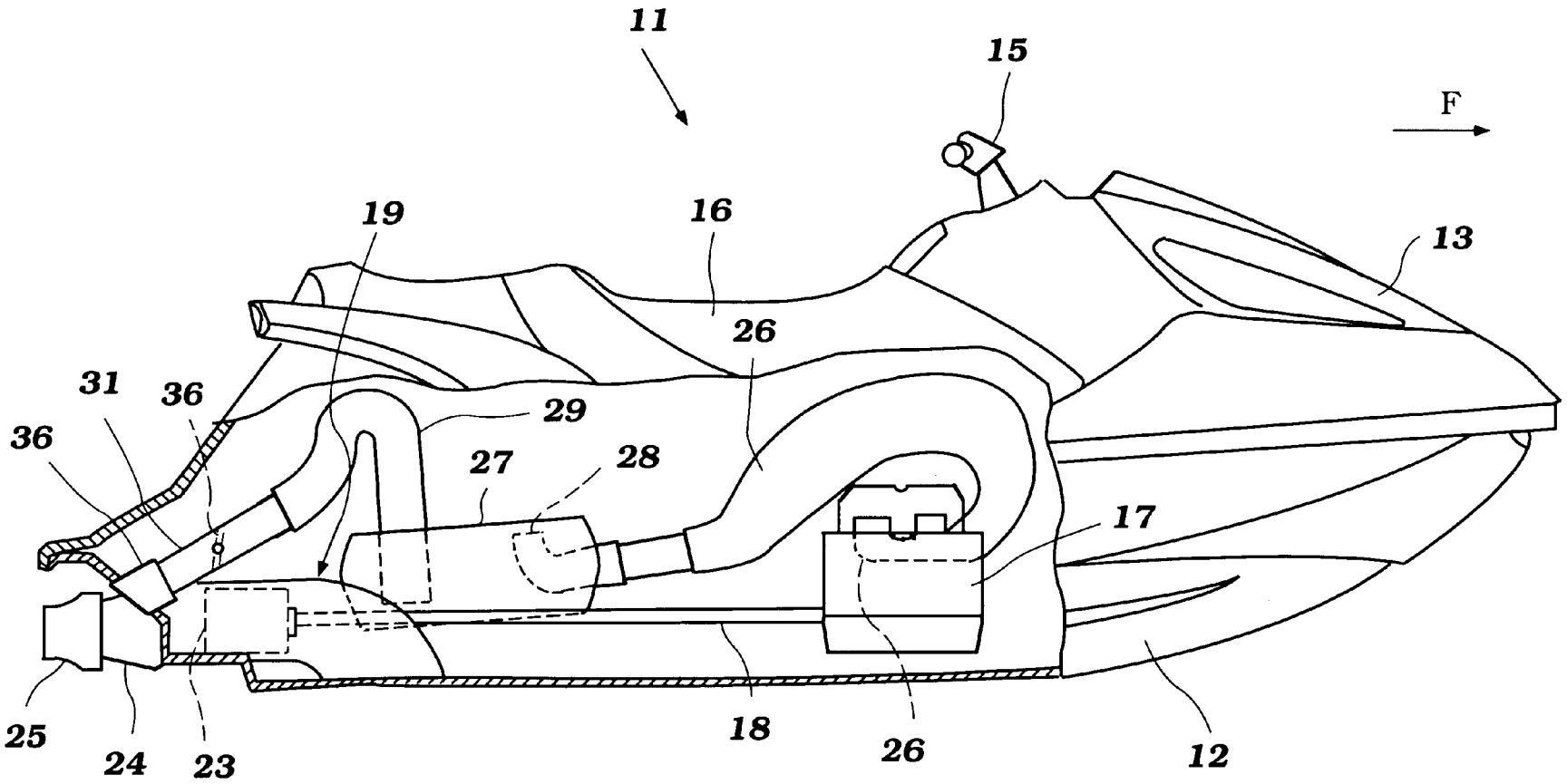
FIG. 1 is a side elevational view of a personal watercraft constructed in accordance with an embodiment of the invention, with a portion of the hull broken away so as to show the engine, propulsion unit and exhaust system.
Figure 2:
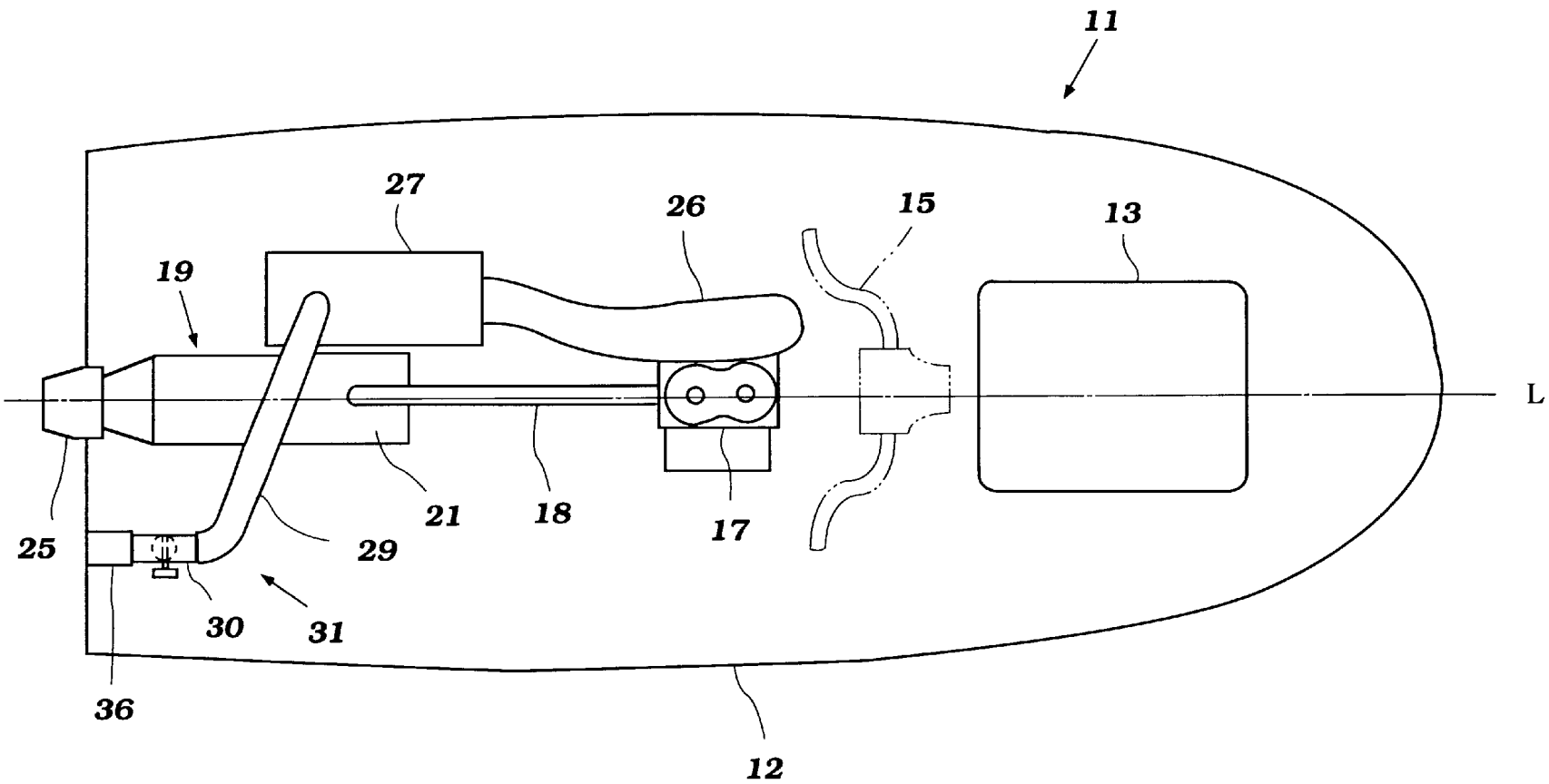
FIG. 2 is a top plan view of the watercraft shown in FIG. 1 with the hull being shown only in outline and the engine and propulsion system and exhaust being shown in solid lines.
Figure 3:
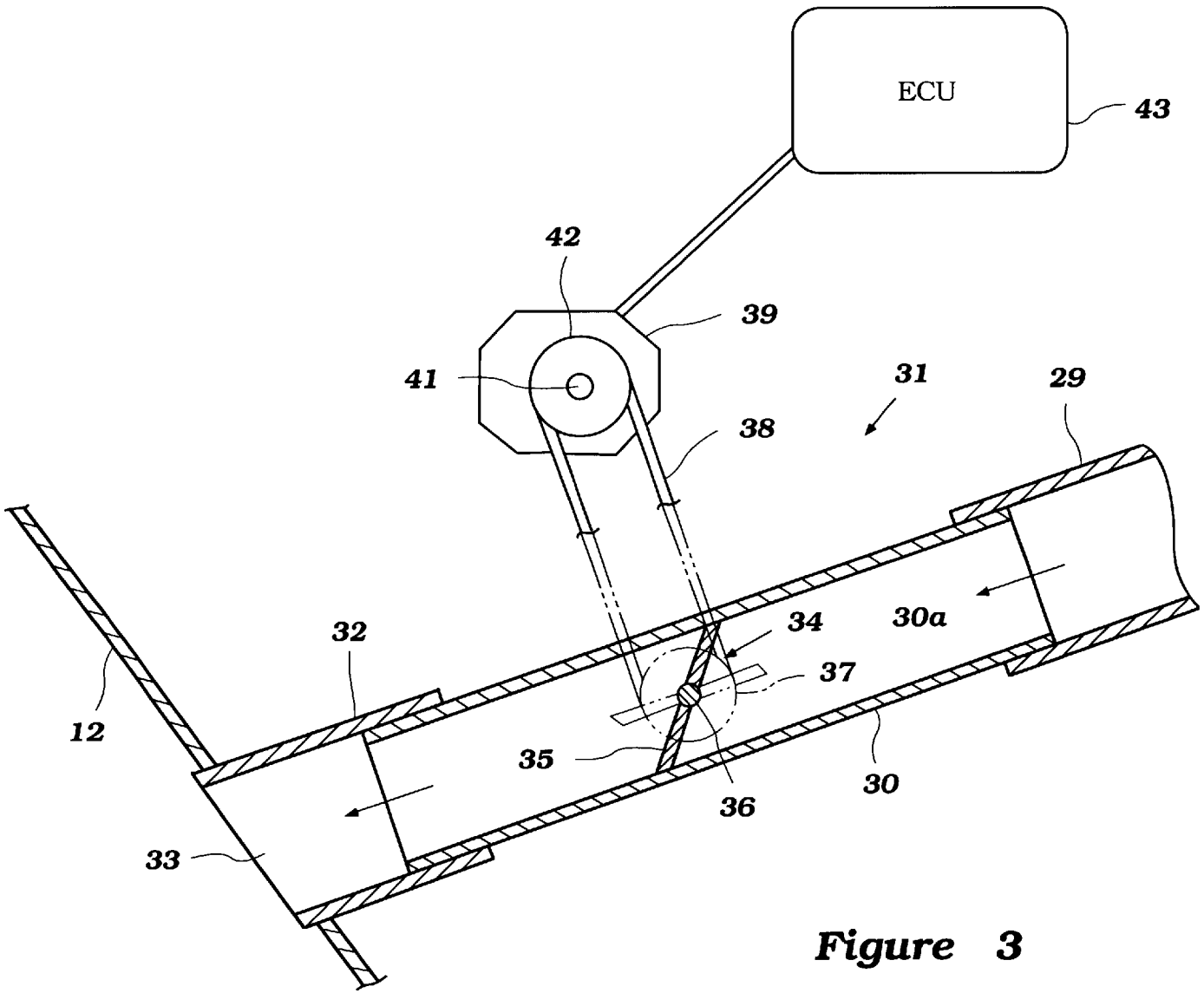
FIG. 3 is an enlarged cross-sectional view showing the silencing device and its orientation in the hull.

Referring first to FIGS. 1–3, a personal watercraft constructed in accordance with a preferred embodiment is identified generally by the reference numeral 11. When the term "personal watercraft" is utilized, it is intended to encompass the type of watercraft defined in the preamble of this application as such watercraft.

The watercraft 1 1 is comprised of a hull assembly that is comprised of a hull 12 and a deck portion 13 which is affixed thereto. The hull 12 and deck portion 13 are formed from a suitable material such as a molded fiberglass reinforced resin or the like. The components are affixed together in a suitable manner and define an engine compartment 14.

The deck portion 13 has provided at its forward part a control mast 15 for control of the watercraft 11. A longitudinally extending seat 16 is formed behind this mast 15. The seat 16 is designed so as to accommodate a single rider operator positioned immediately behind the mast 15. Additional passengers may be carried behind the operator and they will be seated in tandem fashion. No more than three passengers normally occupy this seat 16 along with the rider operator. It should be understood that the foregoing seating arrangement is only typical of the type with which the invention may be employed.

An internal combustion engine, indicated generally by the reference numeral 17 is provided in the engine compartment 14 and is disposed beneath the seat 16. Therefore, the deck portion 13 may be formed with an access opening that can be accessed through removal of the seat 16 or a part thereof it.

The engine 17 is, in the illustrated embodiment, mounted so that its crankshaft rotates about a longitudinally extending axis L. This facilitates coupling to a driveshaft 18 which extends rearwardly and is coupled to the impeller shaft of a jet propulsion unit, indicated generally by the reference numeral 19.

This jet propulsion unit 19 includes an outer housing assembly 21 that forms a downwardly facing water inlet opening 22 through which water may be drawn from the body of water in which the watercraft 11 is operating. This water is pumped by an impeller shown schematically at 23 in FIG. 1 and is discharged rearwardly through a discharge nozzle 24 to provide a propulsion force for the watercraft 11.

As is also known in this art, a steering nozzle 25 is pivotally supported in communication with the discharge nozzle 24. The pivotal position of the steering nozzle 25 is controlled by the mast 15 for steering of the watercraft 11 in a manner well known in this art.

It should be noted that the jet propulsion unit 19 may be accommodated in part in a tunnel formed at the rearward end of the hull portion 12. A suitable bulkhead assembly isolates the engine compartment 14 from this tunnel.

The construction of the watercraft 11 as thus far described may be considered to be conventional. As has been noted above, the invention deals primarily with the exhaust system for the engine 17 and that will now be described referring initially primarily to FIGS. 1 and 2.

The engine 17 may be of any known type. However, in the illustrated embodiment it is depicted as being the two cylinder inline type that operates on a crankcase compression principal. The invention has particularly utility with this type of engine because such engines frequently generate noises that may be objectionable. Of course, the invention can be utilized with engines of other types and other cylinder numbers and configurations.

A combined expansion chamber, exhaust manifold 26 has an inlet end that is fixed to a side of the cylinder block of the engine 17 and collects the exhaust gases from the exhaust port. These exhaust gases are silenced by this expansion and then are again compressed and transferred rearwardly to a water trap device 27 that is disposed on one side of the jet propulsion unit 21 and externally of the hull tunnel portion in which part of this jet propulsion unit may be contained.

The water trap device 27, as is typical in the art, has an inlet 28 at one end thereof from which the exhaust gases from the exhaust manifold 26 are delivered to an upper area of the expansion chamber formed by the water trap device 27. An exhaust discharge pipe 29 extends from a lower portion of the outer housing of the water trap device 27 vertically upwardly and crosses over the top of the jet propulsion unit 19 and the tunnel in which it is contained. This helps to assist in water separation and to ensure that water is not likely to flow backward to the engine through the exhaust system.

Normally, the pipe 29 would discharge the exhaust gases to the atmosphere. In accordance with the invention, however, a silencing device 31 is provided in this exhaust pipe 29 and has a construction as best shown in FIG. 3. The exhaust silencing device 31 is comprised of a exhaust control valve assembly which restricts the flow area of the exhaust pipe 29 under certain running conditions to provide exhaust silencing and improved performance while providing substantially no significant restrictions under other running conditions.

This device and its operation may be thus understood by reference to FIG. 3. As shown in FIG. 3, the silencing device 31 includes a tubular section 30 formed at the end of the exhaust pipe 29 and which terminates in a discharge pipe 32 that extends through a portion of the hull 12 and which has a downwardly and rearwardly facing discharge opening 33.

A control valve assembly, indicated generally by the reference numeral 34 is provided in the pipe section 30. This control valve assembly 34 includes a plate-type valve 35 that is rotatably journaled in a passage 30a of the pipe section 30 on a control valve shaft 36. This shaft 36 extends transversely across the flow passage 30*a*.

FIG. 3 shows in solid lines the closed position of the valve plate 35. Actually, this figure is somewhat of an exaggeration because in this position, the valve plate 35 does not completely close the flow passage 31. That is, there is a clearance between the outer periphery of the control valve 35 and the inner periphery of the pipe section 30 that will provide adequate air flow for engine running conditions up to a predetermined speed and load. Nevertheless, the restriction is adequate to provide a good silencing effect.

One end of the shaft 36 extends outwardly beyond the tubular member 30. A pulley 37 is affixed to this extending end and a belt 38 is trained around the pulley 37. A servo motor 39 is mounted at a convenient location and has an output shaft 41 to which a driving pulley 42 is affixed. This driving pulley 42 drives the belt 38 and, accordingly, moves the control valve plate 35 between its closed position as shown in solid lines in FIG. 3 and its open non-restricting position as shown in phantom line in this same figure.

Figure 4:
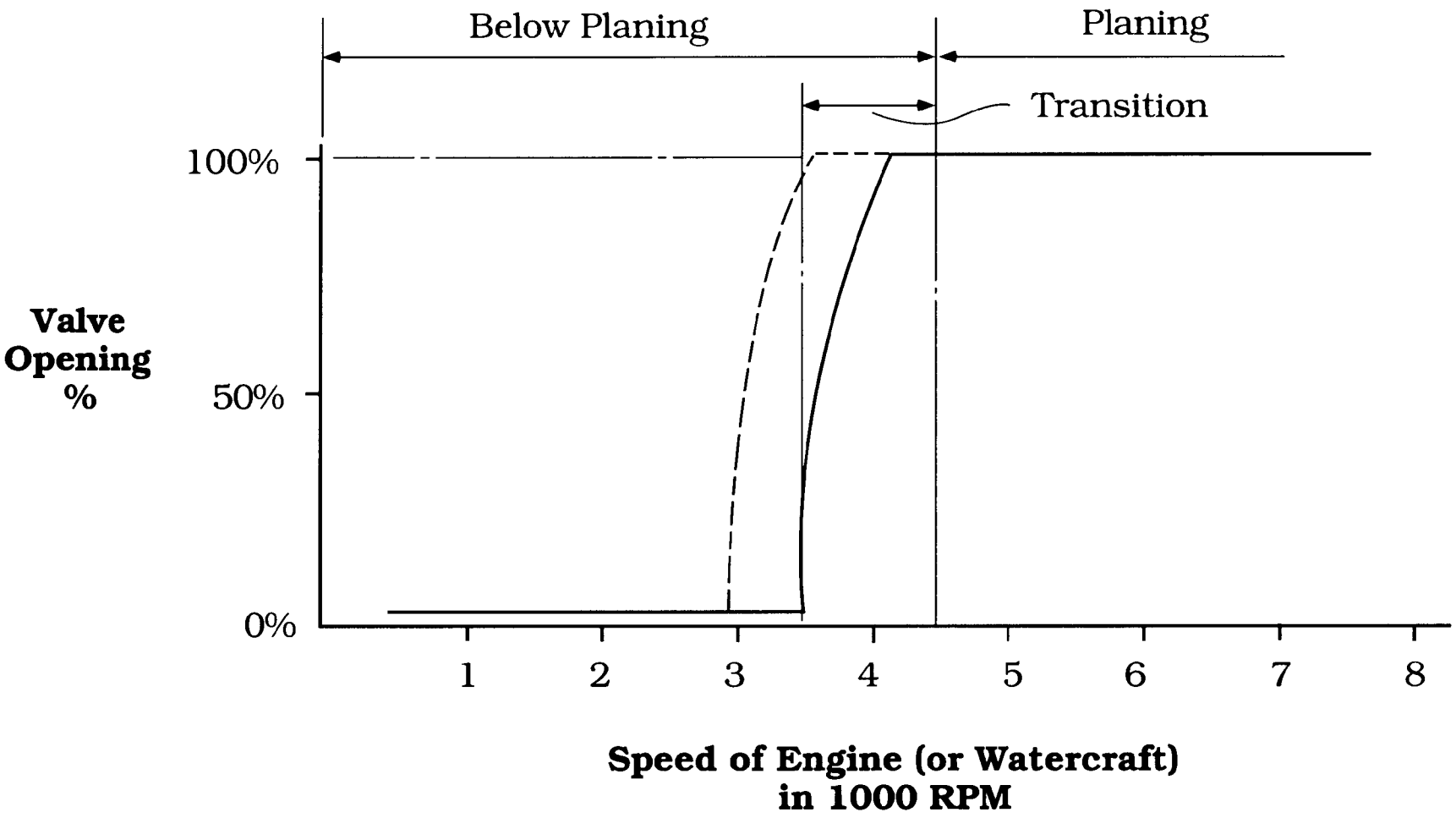
FIG. 4 is a graphical view showing exhaust silencing valve position in relation to engine or vessel speed to explain the control strategy.

An ECU 43 is provided in the watercraft and receives signals indicative of engine speed and/or load so as to adjust the position of the control valve element 35 in accordance with a control routine as best shown in FIG. 4.

As seen in this figure, the control valve opening defined as a percentage of total effective flow area between closed and fully opened is varied in response to engine speed. This is done so that in normal non-planing watercraft condition, the control valve element 35 is maintained in its closed position. However, upon reaching the transition stage before planing, the control valve is rapidly opened so as to reduce the flow restriction, increase power and facilitate acceleration to a planing condition. This opening is done during the transition stage and it may begin either at the beginning of the transition stage as shown in solid lines or slightly before that as shown in phantom line. In any event, the control valve 35 is fully opened before planing condition is totally reached.

Thus, it should be apparent from the foregoing description that the use of the control valve arrangement as described provides this silencing when operating under lower speeds and before planing. However, the control valve is opened during the transitional stage to planing operation so as to permit good power output to be obtained and when the loss of silencing will not be significant. Of course, the foregoing description is that of the preferred embodiment of the invention and various changes and modifications may be made without departing from the spirit and scope of the invention, as defined by the appended claims.

What is claimed is:

1. A personal watercraft having a hull defining a rider's area for accommodating a rider operator and additional passengers seated behind the rider operator in straddle, tandem fashion, an engine compartment provided within said hull and containing a powering internal combustion engine, a propulsion device mounted at least in part beneath said rider's area and driven by said engine for propelling said watercraft through the body of water in which it is operating, said engine being provided with an exhaust system contained within said hull through which exhaust gases are discharged to the atmosphere, said exhaust system including at least one expansion chamber device that receives the exhaust gases from said engine, a conduit extending from said expansion chamber device to an atmospheric discharge, a exhaust silencer valve disposed in said conduit for silencing sounds in the exhaust by restricting the flow area therethrough only under certain running conditions while permitting adequate air flow for said engine for the engine running conditions when the flow area is restricted, and control means for operating said exhaust silencer valve in response to at least one of engine and watercraft running conditions.

2. A personal watercraft as set forth in claim 1 wherein the exhaust silencer valve comprises a butterfly type valve moveable between a maximum restricted position to an unrestricted position.

3. A personal watercraft as set forth in claim 2 wherein the exhaust silencer valve is positioned in response to watercraft speed.

4. A personal watercraft as set forth in claim 3 wherein the exhaust silencer valve is held in its maximum restricted position until vessel speed approaches a planing condition.

5. A personal watercraft as set forth in claim 4 wherein the exhaust silencer valve is rapidly opened as vessel speed approaches a transition to the planing condition.

6. A personal watercraft as set forth in claim 1 wherein the exhaust silencer valve is disposed in an inclined orientation with an inlet end disposed above an outlet end.

7. A personal watercraft as set forth in claim 6 wherein the exhaust silencer valve has a discharge end opening directly through the watercraft hull.

8. A personal watercraft as set forth in claim 7 wherein the exhaust silencer valve discharge end opens through a downwardly facing opening in the hull.

9. A personal watercraft as set forth in claim 7 wherein the expansion chamber comprises a water trap.

10. A personal watercraft as set forth in claim 9 wherein a tunnel in the hull under surface contains the propulsion device.

11. A personal watercraft as set forth in claim 10 wherein the water trap device is on one side of the hull and the exhaust silencer valve is on the other side of the hull.

12. A personal watercraft as set forth in claim 11 wherein the exhaust silencer valve comprises a butterfly type valve moveable between a maximum restricted position to an unrestricted position.

13. A personal watercraft as set forth in claim 12 wherein the exhaust silencer valve is positioned in response to speed.

14. A personal watercraft as set forth in claim 13 wherein the exhaust silencer valve is held in its maximum restricted position until vessel speed approaches a planing condition.

15. A personal watercraft as set forth in claim 14 wherein the exhaust silencer valve is rapidly opened as vessel speed approaches a transition to the planing condition.

* * * * *